US012043923B2

(12) United States Patent
Cai et al.

(10) Patent No.: US 12,043,923 B2
(45) Date of Patent: Jul. 23, 2024

(54) ELASTIC COMPOSITE FIBER AND FABRICATION METHOD THEREFOR

(71) Applicant: Shanghai Haikai Biomaterials Co., Ltd., Shanghai (CN)

(72) Inventors: Tao Cai, Shanghai (CN); Wenxian Ouyang, Shanghai (CN); Yongsheng Feng, Shanghai (CN)

( * ) Notice: Subject to any disclaimer, the term of this patent is extended or adjusted under 35 U.S.C. 154(b) by 590 days.

(21) Appl. No.: 17/285,534

(22) PCT Filed: Aug. 27, 2019

(86) PCT No.: PCT/CN2019/102830
§ 371 (c)(1),
(2) Date: Apr. 15, 2021

(87) PCT Pub. No.: WO2020/232876
PCT Pub. Date: Nov. 26, 2020

(65) Prior Publication Data

US 2021/0388536 A1 Dec. 16, 2021

(30) Foreign Application Priority Data

May 21, 2019 (CN) ..... 201910423144.0

(51) Int. Cl.

| | |
|---|---|
| ***D01F 8/14*** | (2006.01) |
| ***D01D 5/10*** | (2006.01) |
| ***D01D 5/30*** | (2006.01) |
| ***D02J 1/22*** | (2006.01) |

(52) U.S. Cl.
CPC ..... *D01F 8/14* (2013.01); *D01D 5/10* (2013.01); *D01D 5/30* (2013.01); *D02J 1/224* (2013.01); *D10B 2331/04* (2013.01); *D10B 2401/061* (2013.01)

(58) Field of Classification Search
CPC ... D01F 8/14; D01D 5/10; D01D 5/30; D01D 5/084; D01D 10/06; D02J 1/229; D02J 1/224; D02J 1/227; D02J 1/228
See application file for complete search history.

(56) References Cited

U.S. PATENT DOCUMENTS

| | | | | |
|---|---|---|---|---|
| 1,867,619 | A * | 7/1932 | Elssner | D01D 10/06 57/313 |
| RE28,843 | E * | 6/1976 | Buzano | |
| 2002/0012763 | A1* | 1/2002 | Chuah | D01D 5/16 428/97 |
| 2014/0017965 | A1* | 1/2014 | Kawamata | C08G 63/40 528/193 |
| 2019/0153630 | A1* | 5/2019 | Zhou | D01F 8/14 |

FOREIGN PATENT DOCUMENTS

| | | | |
|---|---|---|---|
| CN | 104141178 | A * | 11/2014 |
| CN | 105908268 | A * | 8/2016 |
| CN | 205576365 | * | 9/2016 |
| CN | 107268118 | * | 10/2017 |

OTHER PUBLICATIONS

Espacenet translation of CN-104141178-A. (Year: 2014).*
Espacenet translation of CN-105908268-A. (Year: 2016).*
CN107268118 machine translation (Year: 2017).*
CN205576365 machine translation (Year: 2016).*

* cited by examiner

*Primary Examiner* — S. Behrooz Ghorishi
*Assistant Examiner* — Alexander A Wang

(57) ABSTRACT

Disclosed is an elastic composite fiber, comprising a fiber body, wherein according to weight percentage, the material composition of the fiber body is made by composite spinning 10%-90% low viscosity PET, 10%-90% high viscosity PET, 10-80% PTT and 10-80% PBT. The present invention combines the advantages of the PET, PTT and PBT fibers into one, and not only has the advantages of good spinnability, high strength, good elasticity, softness, comfortableness, easy dyeing, moisture absorption and the like, but also utilizes reasonable cooperation between materials and the difference between physical and chemical properties to make the three-dimensional structure of the composite fiber more remarkable and the thermal stability better.

4 Claims, No Drawings

ELASTIC COMPOSITE FIBER AND FABRICATION METHOD THEREFOR

BACKGROUND OF THE INVENTION

The present invention relates to a kind of elastic composite fiber and a production method thereof.

Following the improvement in living standard, customer's requirements for clothing fashions are getting higher. Stretch fabric is extremely popular internationally. Spandex (Polyurethane fiber) is the major raw material for super stretch fabric in China, but spandex is rarely used alone to form fabric due to its high elasticity and easy displacement, instead, other yarns are generally also used together to make core-spun yarns or covered yarns for weaving. Spandex weaving technology is complicated and its dyeability is poor. Currently, a three-dimensional crimped elastic staple has been developed in the market, which is a mechanically crimped elastic fiber produced from a single-component PET three-dimensional crimped hollow fiber crimped by a mechanical crimping machine and then formed in shape by a relax heat setting machine. The production method of the elastically formed three-dimensional hollow fiber is mainly achieved by the crimping machine. Experiments have shown that elastic fiber produced according to hollow fiber production method has good spinnability, low density and better fluffiness. However, since the conventional three-dimensional hollow fiber is a single-component fiber, its fluffiness and texture are very different from wool, and it is not so elastic or simply not elastic.

In recent years, composite fiber is widely discussed and studied. Composite fiber is a kind of multi-component fiber. In other words, two or more kinds of polymer fibers not mutually blended together co-exist in the same fiber cross section, for example composite fibers like PET/PTT composite fiber and PET/PBT composite fiber. CN109137137A (application number 201810987214.0) (the applicant of the present invention being one of the joint-applicants) also disclosed an elastic composite fiber and a production method thereof, specifically comprising a fiber body consisting of PET of low viscosity, PET of high viscosity, and PTT; by means of these three materials, elastic composite fiber can be manufactured in the relevant fields of art. However, the resulting elastic composite fiber has only unimpressive performance in three-dimensional crimping, and has poor performance in heat stability.

Therefore, the inventors have come up with this invention after thorough studies of the above mentioned problems in the prior art.

BRIEF SUMMARY OF THE INVENTION

In view of the aforesaid disadvantages now present in the prior art, it is an object of the present invention to provide a kind of elastic composite fiber and a production method thereof. The present invention prepares a kind of PTT/PET/PBT composite fiber; due to reasonable coordination between materials and differences between the materials in terms of physical and chemical properties, a material with better fluffiness, more obvious three-dimensional structure and better thermal stability can be obtained.

To attain the above object, the present invention provides the following technical solutions:

Elastic composite fiber, comprising a fiber body, characterized in that, the fiber body is formed by compound spinning of the following components in weight percentage: low viscosity PET10%-90%, high viscosity PET10%-90%, PTT10-80%, PBT10-80%.

As a preferred embodiment of the present invention, a viscosity of the low viscosity PET is 0.4-0.7 dL/g, a viscosity of the high viscosity PET is 0.7-0.9 dL/g, a viscosity of the PTT is 0.7-1.3 dL/g, and a viscosity of the PBT is 0.7-1.3 dL/g, and a number of crimps of the fiber body is 5-15 per cm.

As a preferred embodiment of the present invention, the weight percentage of the low viscosity PET is 20%, the weight percentage of the high viscosity PET is 20%, the weight percentage of the PTT is 30%, and the weight percentage of the PBT is 30%.

Correspondingly, the present invention also provides a method of producing elastic composite fiber, comprising the following steps:

Step A: Drying low viscosity PET, high viscosity PET, PTT, and PBT, until water content is less than 15 ppm: wherein a viscosity of the low-viscosity PET is 0.4-0.7 dL/g, a viscosity of the high viscosity PET is 0.7-0.9 dL/g, a viscosity of the PTT is 0.7-1.3 dL/g, and a viscosity of the PBT is 0.8-1.2 dL/g;

Step B: placing the low viscosity PET, the high viscosity PET, the PTT, and the PBT into a screw extruder to carry out melt extrusion procedure to obtain molten material; transferring the molten material into a compound spinning assembly under measurements determined through a metering pump, wherein a weight percentage of the low viscosity PET accounts for 10-90% of total molten material transferred to the compound spinning assembly, a weight percentage of the high viscosity PET accounts for 10-90% the total molten material transferred to the compound spinning assembly, a weight percentage of the PTT accounts for 10-80% of the total molten material transferred to the compound spinning assembly, and a weight percentage of the PBT accounts for 10-80 of the total molten material transferred to the compound spinning assembly; introducing the molten material out from the compound spinning assembly into a spinneret where the molten material is extruded to form parallel vacuum staples which are then subject to spinning, circular cooling, oil application, winding, and arrangement around a bobbin, thereby obtaining a non-crimped top fiber precursor;

Step C: balancing the fiber precursor obtained in step B for 20 hours and then performing setting procedure by tension heat setting or relax heat setting; wherein said tension heat setting achieves setting through stretching by using a first traction roller, a second traction roller, a third traction roller and a fourth traction roller.

As a preferred embodiment of the present invention, the compound spinning assembly is a spinning component of a large-capacity dual-channel composite spinning device comprising an upper housing, a filter cavity, a distribution plate A, a distribution plate B, a distribution plate C, a spinneret, a pressing block and a lower shell, as disclosed in CN205576365U (Chinese utility model application number 201620335529.3).

As a preferred embodiment of the present invention, the first traction roller operates at a speed of 220-280 m/min and a temperature of 154-170° C.; the second traction roller operates at a speed of 222-282 m/min and a temperature of 170-180° C.; the third traction roller operates at a speed of 225-285 m/min and a temperature of 170-180° C.: and the fourth traction roller operates at a speed of 230-290 m/min and a temperature of 180° C.

As a preferred embodiment of the present invention, said relax heat setting is operated under a temperature of 80-120° C. for 2-6 min;

Compared with the prior art, the present invention has the following beneficial effects:

1. The present invention fills up a technical gap in the market by providing a kind of composite elastic fiber comprising 3 types of fibers, namely PET, PTT and PBT.
2. The present invention integrates the advantages of PET, PTT, and PBT fibers. Therefore, the resulting composite elastic fiber has the advantages of good spinnability, great strength, good elasticity, and it is also soft and comfortable, moisture-absorptive, and easy to dye. Further, due to reasonable coordination between materials and differences between the materials in terms of physical and chemical properties, the three-dimensional structure of the composite fiber is ore prominent with better thermal stability.
3. The present invention makes use of the different molecular structures and different crystallization characteristics of PET, PTT and PBT to obtain the compound characteristics of self-crimping and elasticity, and parallel PTT/PET/PBT compound elastic staples are then produced through the spinning component of the large-capacity dual-channel composite spinning device; the compound elastic staples are very fluffy, soft, colorful, and has certain elasticity and elastic recovery, also, their three-dimensional structures are more prominent, and they have better thermal stability, Hence, the present invention solves the problems such as high price, poor fluffiness, poor texture, poor dyeability and easy decolorization as in conventional elastic fibers.
4. Compared with spandex, the present invention saves the technical procedure of snaking core-spun yarn, and thus simplifies the operation process, which greatly saves laboring costs and reduces the waste of resources.
5. The composite material produced by the present invention has a wide range of applications suitable for the production of carpets, casual wear, fashion clothes, undergarment, sportswear, swimwear and socks etc.

DETAILED DESCRIPTION OF THE INVENTION

The present invention is further described below in detail with reference to some embodiments. However, the present invention is not limited to the described embodiments. Various changes or alternative configurations made in accordance with the common technical knowledge and prior art means of this field of art without deviating from the technical concept of the present invention should also fall within the scope of the present invention.

Embodiment 1

A method of producing elastic composite fiber, comprising the following steps:

Step A: Drying low viscosity PET, high viscosity PET, PTT, and PBT, until water content is less than 15 ppm; wherein a viscosity of the low-viscosity PET is 0.42 dL/g, a viscosity of the high viscosity PET is 0.83 dL/g, a viscosity of the PTT is 0.92 dL/g, and a viscosity of the PBT is 0.92 dL/g;

Step B: placing the low viscosity PET, the high viscosity PET, the PTT, and the PBT into a screw extruder to carry out melt extrusion procedure to obtain molten material; transferring the molten material into a compound spinning assembly under measurements determined through a metering pump, wherein the compound spinning assembly is a spinning component of a large-capacity dual-channel composite spinning device and a weight percentage of the low viscosity PET accounts for 20% of total molten material transferred to the compound spinning assembly, a weight percentage of the high viscosity PET accounts for 20% of the total molten material transferred to the compound spinning assembly, a weight percentage of the PTT accounts for 30% of the total molten material transferred to the compound spinning assembly, and a weight percentage of the PBT accounts for of the total molten material transferred to the compound spinning assembly; introducing the molten material out from the compound spinning assembly into a spinneret where the molten material is extruded to form parallel vacuum staples which are then subject to spinning, circular cooling, oil application, winding, and arrangement around a bobbin, thereby obtaining a non-crimped top fiber precursor;

Step C: balancing the fiber precursor obtained in step B for 20 hours and then performing setting procedure by tension heat setting; wherein said tension heat setting achieves setting through stretching by using a first traction roller, a second traction roller, a third traction roller and a fourth traction roller; wherein the first traction roller operates at a speed of 250 m/min and a temperature of 160'C; the second traction roller operates at a speed of 250 m/min and a temperature of 175'C; the third traction roller operates at a speed of 250 m/min and a temperature of 175° C.; and the fourth traction roller operates at a speed of 250 m/min and a temperature of 180'C, In the present embodiment, the first traction roller, the second traction roller, the third traction roller and the fourth traction roller can each be used in a quantity more than one. The operating temperatures of the traction rollers increase gradually from the first to the fourth traction roller, so that the fiber receives more even heating and reflects a more even temperature so as to obtain a better formed structure which is also more stable.

Properties of the composite fiber obtained according to embodiment 1 are illustrated below:

| | |
|---|---|
| Strength (cN/dtex) | 4.3 |
| Modulus (cN/dtex) | 50 |
| Fracture elongation (%) | 38 |
| Shrinkage in boiling water (%) | 12 |
| Number of crimps (number/cm) | 23 |
| Fluffiness (150 g) | 85% |

Embodiment 2

Step A: Drying low viscosity PET, high viscosity PET, PTT, and PBT, until water content is less than 15 ppm; wherein a viscosity of the low-viscosity PET is 0.42 dL/g, a viscosity of the high viscosity PET is 0.83 dL/g, a viscosity of the PTT is 0.92 dL/g, and a viscosity of the PBT is 0.92 dL/g;

Step B: placing the low viscosity PET, the high viscosity PET, the PTT, and the PBT into a screw extruder to carry out melt extrusion procedure to obtain molten material; transferring the molten material into a compound spinning assembly under measurements determined through a metering pump, wherein the compound spinning assembly is a spinning component of a large-capacity dual-channel composite spinning device, and a weight percentage of the low viscosity PET accounts for of total molten material transfer red to the compound spinning assembly, a weight percentage of the high viscosity PET accounts for 20% of the total molten material transferred to the compound spinning assembly, a weight percentage of the PTT accounts for 30% of the total molten material transferred to the compound spinning assembly, and a weight percentage of the PBT accounts for 30% of the total molten material transferred to the compound spinning assembly; introducing the molten material out from the compound spinning assembly into a spinneret where the molten material is extruded to form parallel staples which are then subject to spinning, circular cooling, oil application, winding, and arrangement around a bobbin, thereby obtaining a non-crimped top fiber precursor;

Step C: performing setting procedure of the fiber precursor obtained in step B by relax heat setting; wherein said relax heat setting is operated under a temperature of 100'C for 4 min. During the process of fiber setting, internal stress is released; arrangement of macromolecules has not reached the most stable condition; crimping condition of the fiber is stable; by using a tension-free condition, said relax heat setting allows the fiber to be fully relax to eliminate the internal stress of the fiber so as to perfect the fiber structure and make it stable.

Properties of the composite fiber obtained according to embodiment 2 are illustrated below:

| | |
|---|---|
| Strength (cN/dtex) | 4.1 |
| Modulus (cN/dtex) | 53 |
| Fracture elongation (%) | 44 |
| Shrinkage in boiling water (%) | 11 |
| Number of crimps (number/cm) | 23 |
| Fluffiness (150 g) | 87% |

Embodiment 3

A method of producing elastic composite fiber, comprising the following steps:

Step A: Drying low viscosity PET, high viscosity PET, PTT, and PBT, until water content is less than 15 ppm; wherein a viscosity of the low-viscosity PET is 0.55 dL/g, a viscosity of the high viscosity PET is 0.75 dL/g, a viscosity of the PTT is 0.95 dL/g, and a viscosity of the PBT is 0.95 dL/g;

Step B: placing the low viscosity PET, the high viscosity PET, the PTT, and the PBT into a screw extruder to carry out melt extrusion procedure to obtain molten material; transferring the molten material into a compound spinning assembly under measurements determined through a metering pump, wherein the compound spinning assembly is a spinning component of a large-capacity dual-channel composite spinning device, and a weight percentage of the low viscosity PET accounts for 20% of total molten material transferred to the compound spinning assembly, a weight percentage of the high viscosity PET accounts for 20% of the total molten material transferred to the compound spinning assembly, a weight percentage of the PTT accounts for 30% of the total molten material transferred to the compound spinning assembly, and a weight percentage of the PBT accounts for 30% of the total molten material transferred to the compound spinning assembly; introducing the molten material out from the compound spinning assembly into a spinneret where the molten material is extruded to form parallel staples which are then subject to spinning, circular cooling oil application, winding, and arrangement around a bobbin, thereby obtaining a non-crimped top fiber precursor;

Step C: balancing the fiber precursor obtained in step B for 20 hours and then performing setting procedure by tension heat setting; wherein said tension heat setting achieves setting through stretching by using a first traction roller, a second traction roller, a third traction roller and a fourth traction roller wherein the first traction roller operates at a speed of 250 m/min and a temperature of 160° C.; the second traction roller operates at a speed of 250 m/min and a temperature of 175° C.; the third traction roller operates at a speed of 250 m/min and a temperature of 175° C.; and the fourth traction roller operates at a speed of 250 m/min and a temperature of 180° C.

Properties of the composite fiber obtained according to embodiment 3 are illustrated below:

| | |
|---|---|
| Strength (cN/dtex) | 4.0 |
| Modulus (cN/dtex) | 48 |
| Fracture elongation (%) | 45 |
| Shrinkage in boiling water (%) | 13 |
| Number of crimps (number/cm) | 26 |
| Fluffiness (150 g) | 90% |

Embodiments 4-6

Except for the weight ratio between the low viscosity PET, the high viscosity PET, the PTT and the PBT, embodiments 4-6 have the same method as described in embodiment 3. Properties of the composite elastic fiber obtained according to embodiments 4-6 are illustrated below:

| | 1:1:4:4 (weight ratio between low viscosity PET:high viscosity PET:PTT:PBT) | 2:4:1:1 (weight ratio between low viscosity PET:high viscosity PET:PTT:PBT) | 4:2:1:1 (weight ratio between low viscosity PET:high viscosity PET:PTT:PBT) |
|---|---|---|---|
| Strength (cN/dtex) | 4.5 | 5.3 | 4.0 |
| Modulus (cN/dtex) | 52 | 56 | 47 |
| Fracture elongation (%) | 40 | 35 | 42 |
| Shrinkage in boiling water (%) | 10 | 12 | 13 |
| Number of crimps (number/cm) | 20 | 22 | 23 |
| Fluffiness (150 g) | 89% | 92% | 95% |

Embodiments 7-9

Except for the difference in viscosity between the low viscosity PET, the high viscosity PET the PIT and the PBT, embodiments 7-9 have the same method as described in embodiment 3. Properties of the composite fiber obtained according to embodiments 7-9 are illustrated below

| | low viscosity PET 0.5 dL/g, high viscosity PET 0.7 dL/g, PTT 0.7 dL/g and PBT 0.75 dL/g | low viscosity PET 0.6 dL/g, high viscosity PET 0.78 dL/g, PTT 0.9 dL/g and PBT 0.9 dL/g | low viscosity PET 0.67 dL/g, high viscosity PET 0.8 dL/g, PTT 1.1 dL/g and PBT 1.1 dL/g |
|---|---|---|---|
| Strength (cN/dtex) | 4.2 | 4.5 | 5.0 |
| Modulus (cN/dtex) | 47 | 52 | 55 |
| Fracture elongation (%) | 35 | 32 | 30 |
| Shrinkage in boiling water (%) | 12 | 15 | 11 |
| Number of crimps (number/cm) | 21 | 20 | 22 |
| Fluffiness (150 g) | 87% | 90% | 93% |

In the present invention, the described screw extruder is divided into five zones. Temperatures of the five zones are 265° C., 275° C., 280° C., 280° C. and 275° C. respectively.

In the present invention, the staple fibers extruded from the spinneret are cooled by circular blow air at a temperature of 20° C. and a speed of 2 m/s.

In the present invention, the low viscosity PET can be obtained by polymerizing terephthalic acid and excess diol. During polymerization, the excess diol is in excess by 33% (molar ratio), wherein the diol comprises propane-1,2-diol (propylene glycol) and diethylene glycol. A molar ratio of glycol, propane-1,2-diol and diethylene glycol is controlled in a range of 70:30-50:50. With the increase in proportion of the diethylene glycol in the molar ratio, fluidity of the low viscosity PET will increase, and its strength will gradually decrease. High viscosity PET can be obtained by thickening conventional PET, specifically, through a liquid phase thickening procedure which purifies and increases the viscosity of conventional PET by extracting small liquid molecules. After thickening treatment, the strength of PET increases, and such increase in strength is of great importance to increase the hardness of the resulting composite fiber. The PIT and the PBT used in the present invention can be conventional PTT and PBT available in the market.

Control Embodiment

Technical solutions provided by CN10937137A (application number 201810987214.0)

Except for the difference in weight ratio between low viscosity PET, high viscosity PET, and PTT, the method of production is the same as described in embodiment 3. Properties of the elastic composite fiber obtained according to embodiments 7-9 are illustrated below:

| | 1:1:8 (weight ratio between low viscosity PET:high viscosity PET:PTT) | 1:2:1 (weight ratio between low viscosity PET:high viscosity PET:PTT) | 2:1:1 (weight ratio between low viscosity PET:high viscosity PET:PTT) |
|---|---|---|---|
| Strength (cN/dtex) | 3.7 | 4.5 | 3.2 |
| Modulus (cN/dtex) | 40 | 52 | 35 |
| Fracture elongation (%) | 40 | 35 | 42 |
| Shrinkage in boiling water (%) | 30 | 28 | 32 |
| Number of crimps (number/cm) | 10 | 4 | 6 |

| | low viscosity PET 0.5 dL/g, high viscosity PET 0.7 dL/g, and PTT 0.75 dL/g | low viscosity PET 0.6 dL/g, high viscosity PET 0.78 dL/g, and PTT 0.9 dL/g | low viscosity PET 0.67 dL/g, high viscosity PET 0.8 dL/g, and PTT 1.1 dL/g |
|---|---|---|---|
| Strength (cN/dtex) | 3.6 | 3.9 | 4.2 |
| Modulus (cN/dtex) | 40 | 45 | 47 |
| Fracture elongation (%) | 35 | 32 | 30 |
| Shrinkage in boiling water (%) | 36 | 32 | 28 |
| Number of crimps (number/cm) | 10 | 7 | 5 |

By comparing the properties of the composite fiber produced according to embodiments 1-9 of the present invention and according to the control embodiment provided by CN109137137A (application number 201810987214.0) it is observed that the composite fiber produced by the present invention has greater strength and is significantly better in terms of three-dimensional crimping and heat stability.

Although some embodiments of the present invention have been described above, a person skilled in the art may make other changes and modifications based on the described embodiments in accordance with the basic inventive concept of tee present invention. Therefore: the described embodiments are only illustrative examples of the present invention and should not limit the scope of protection of the present invention. Any alternative configurations or alternative sequence of steps based on the description of the present invention, or the use of the present invention directly or indirectly in other fields of art should as ell fall within the scope of protection of the present invention.

What is claimed is:

1. A method of producing elastic composite fiber, comprising the following steps:

step A: drying low viscosity PET, high viscosity PET, PTT, and PBT, until water content is less than 15 ppm; wherein a viscosity of the low viscosity PET is 0.4-0.7 dL/g, a viscosity of the high viscosity PET is 0.7-0.9 dL/ g, a viscosity of the PTT is 0.7-1.3 dL/g, and a viscosity of the PBT is 0.8-1.2 dL/g;

step B: placing the low viscosity PET, the high viscosity PET, the PTT, and the PBT into a screw extruder to carry out melt extrusion procedure to obtain molten material; transferring the molten material into a compound spinning assembly under measurements determined through a metering pump, wherein a weight percentage of the low viscosity PET accounts for 10-90% of total molten material transferred to the compound spinning assembly, a weight percentage of the high viscosity PET accounts for 10-90% of the total molten material transferred to the compound spinning assembly, a weight percentage of the PTT accounts for 10-80% of the total molten material transferred to the compound spinning assembly, and a weight percentage of the PBT accounts for 10-80% of the total molten material transferred to the compound spinning assembly; introducing the molten material out from the compound spinning assembly into a spinneret where the molten material is extruded to form parallel vacuum staples which are then subject to spinning, circular cooling, oil application, winding, and arrangement around a bobbin, thereby obtaining a non-crimped top-fiber precursor;

step C: equilibrating the fiber precursor obtained in step B for 20 hours and then performing setting procedure by tension heat setting or relax heat setting; wherein said tension heat setting achieves setting through stretching by using a first traction roller, a second traction roller, a third traction roller and a fourth traction roller;

wherein the first traction roller operates at a speed of 220-280 m/min and a temperature of 150-170° C.; the second traction roller operates at a speed of 222-282 m/min and a temperature of 170-180°C; the third traction roller operates at a speed of 225-285 m/min and a temperature of 170-180°C; and the fourth traction roller operates at a speed of 230-290 m/min and a temperature of 180° C.

2. The method of producing elastic composite fiber of claim 1, wherein the compound spinning assembly is a spinning component of a large-capacity dual-channel composite spinning device comprising an upper housing, a filter cavity, a distribution plate A, a distribution plate B, a distribution plate C, a spinneret, a pressing block and a lower shell.

3. The method of producing elastic composite fiber of claim 1, wherein said relax heat setting is operated under a temperature of 80-120° C. for 2-6 min.

4. The method of producing elastic composite fiber of claim 2, wherein said relax heat setting is operated under a temperature of 80-120° C. for 2-6 min.

* * * * *